United States Patent [19]

Taub et al.

[11] Patent Number: 4,715,906

[45] **Date of Patent: * Dec. 29, 1987**

[54] ISOTHERMAL HOLD METHOD OF HOT WORKING OF AMORPHOUS ALLOYS

[75] Inventors: Alan I. Taub, Schenectady; Peter G. Frischmann, Scotia, both of N.Y.

[73] Assignee: General Electric Company, Schenectady, N.Y.

[ * ] Notice: The portion of the term of this patent subsequent to Apr. 22, 2003 has been disclaimed.

[21] Appl. No.: 839,317

[22] Filed: Mar. 13, 1986

[51] Int. Cl.[4] ..... H01F 1/00

[52] U.S. Cl. ..... 148/120; 72/200; 72/342; 72/364

[58] Field of Search ..... 148/120, 121, 122, 403; 72/200, 342, 364

[56] References Cited

U.S. PATENT DOCUMENTS

| | | | |
|---|---|---|---|
| 4,284,441 | 8/1981 | Satoh et al. | 148/120 |
| 4,288,260 | 9/1981 | Senno et al. | 148/121 |
| 4,444,602 | 4/1984 | Makino et al. | 148/121 |
| 4,482,402 | 11/1984 | Taub | 148/121 |
| 4,584,036 | 4/1986 | Taub et al. | 148/120 |
| 4,596,613 | 6/1986 | Lin et al. | 148/122 |

FOREIGN PATENT DOCUMENTS

| | | | |
|---|---|---|---|
| 51-73923 | 6/1976 | Japan . | |
| 57-79158 | 5/1982 | Japan . | |
| 57-140824 | 8/1982 | Japan | 148/121 |
| 58-37126 | 3/1983 | Japan | 148/121 |

OTHER PUBLICATIONS

Scaling the Kinetics of Flow and Relaxation in Amorphous Alloys; Materials Science & Engineering, 62 (1984) 249–260, by A. Taub and J. Walter.

*Primary Examiner*—John P. Sheehan

*Attorney, Agent, or Firm*—Paul E. Rochford; James C. Davis, Jr.; Paul R. Webb, II

[57] ABSTRACT

The problem of working an amorphous alloy is overcome by heating the alloy at a rate of temperature increase above about 1000° C. per minute. The amorphous alloy is worked by homogeneous deformation after its temperature has been very rapidly increased to above the softening temperature of the alloy. Desirable magnetic properties of the alloy are preserved by working the alloy in this fashion and also tool life is extended.

10 Claims, 2 Drawing Figures

ISOTHERMAL HOLD METHOD OF HOT WORKING OF AMORPHOUS ALLOYS

CROSS REFERENCE TO RELATED APPLICATIONS

The present invention relates to pending application Ser. No. 657,329, filed Oct. 3, 1984 of the same inventors, assigned to the same assignee as the subject application and now U.S. Pat. No. 4,584,036.

BACKGROUND OF THE INVENTION

The present invention relates generally to the working or forming of amorphous alloy materials which are difficult to work. More specifically, it relates to the cutting, slitting, rolling or stamping of amorphous alloys.

It is known that several working or forming operations which may be performed on amorphous alloys such as cutting, slitting, rolling or stamping are operations which are difficult to perform when the material treated is at room temperature. The deformation of any material requires a flow of the material as the material is formed or worked. At low temperatures the flow of amorphous alloys is governed by an inhomogeneous deformation mechanism. This deformation mechanism is characterized by high stresses and because of the high stresses the tools used in the forming operations have short useful lives. In addition, it is known that inhomogeneous deformation of amorphous alloys is detrimental to the soft magnetic properties of the alloys.

It has been known, heretofore, that some of the difficulties in forming the amorphous alloys can be overcome or reduced by performing the forming operations at elevated temperatures. This has been reported by Masumoto in Japanese patent application No. 132288, dated Nov. 5, 1976. In this publication, it is taught that forming processes should be applied to the amorphous alloy only at temperatures above the "ductile transition temperature" and this temperature is designated as $T_p$. The same temperature which has been regarded as critical for working has also been referred to as the "plastic transition temperature" in an article by Liebermann, in Mat. Sci. Eng. 46, 241 (1980). It is known that above this plastic transition temperature the amorphous alloys can be deformed at low stresses to a high degree of straining. Patterson et al. reported the hot forming of a metallic glass and demonstrated this hot forming by drawing a cup from a ribbon of amorphous alloy. This is reported in J. Patterson, A. L. Greer, J. A. Leake and D. R. H. in "Proceedings Third International Conference on Rapidly Quenched Metals", (Chameleon Press, 1978), p. 293.

More recently, Homer and Eberhardt produced strains approaching 1000% in an amorphous alloy ribbon of PdFeSi at stresses as low as 150 Mpa by a deformation which was carried out at high temperatures. This was reported in Scripta Met. 14, 1331 (1980).

In none of the foregoing studies and methods developed from the studies was there any concern with the effect of the rate of heating of the article to be formed on the forming of the amorphous article. Primary consideration of this prior art work was the consideration of the crystallization kinetics of the alloy. An object was to effect the working without imparting significant degrees of crystallinity to the product. In this way it was sought to retain the amorphous character of the article which was being formed. The avoidance of crystallization is a primary consideration in preserving the properties of the amorphous alloys.

We had previously succeeded in discovering a relationship between the softening and increase in workability of an amorphous alloy article and the heating rate or the rate at which the article is undergoing heating at the time it is worked. That relationship is set out in copending application for Pat. Ser. No. 657,329. filed Oct. 3, 1984 and referenced above. We found that it was important to distinguish between the heating history of the article, that is the heating to a certain temperature prior to working or the rate at which an article has been heated to attain a certain temperature prior to working, and the effect which we had found to be important, namely the rate at which an article is being heated at the very time the working or forming of the article is taking place. We had found that an article such as an amorphous alloy undergoes a softening when and, more specifically, during the time when it is undergoing the heating at a relatively high heating rate. Further, we had succeeded in determining the variation of the softening temperature with or as a function of the heating rate in a quantitative manner. All of these findings and the quantitative relationships on which they are based are set out in copending application for U.S. Pat. Ser. No. 657,329, referenced above.

We have now found that another and distinct relationship exists which is very important to the processing of amorphous alloys. Further, this new relationship provides more latitude of processing steps than prior art methods or the method of the referenced copending application.

BRIEF STATEMENT OF THE INVENTION

It is, accordingly, one object of the present invention to provide an improved method by which amorphous alloys may be deformed or otherwise worked.

Another object is to provide novel articles which result from their being worked by this novel method.

Another object is to provide a method which makes possible the attainment of processing of amorphous alloys at temperatures below the "ductile transition temperature" or "plastic transition temperature" by the use of a very high heating rate.

Other objects will be in part apparent and in part pointed out in the description which follows.

In one of its broader aspects, objects of the present invention can be achieved by first providing an amorphous alloy to be worked. The next step is to subject the amorphous alloy sample to a very rapid rate of heating. The third step is to subject the article to stress to work the article during a very brief approximate isothermal hold. By an approximate isothermal hold is meant a maintenance of the temperature of an article at a temperature to which it has been heated and avoiding any substantial drop in temperature during the time the article is at the hold temperature. For the purposes of this invention, the duration of the isothermal hold is measured in seconds.

While the Applicants do not wish to be bound by the theory, an explanation of the mechanism of the phenomena which is the basis for preservation of desirable magnetic properties in an amorphous alloy which has been worked in accordance with the practice of the present invention is offered here for assistance to those seeking to preserve such desirable magnetic properties.

If a stress is applied to an amorphous alloy sample, the mode in which deformation occurs as a result of the applied stress is significant to the magnetic properties of the deformed sample. An amorphous alloy sample may deform either in a discrete and inhomogeneous manner if the measures used in the deformation do not conform to those provided by the present invention or in accordance with prior application Ser. No. 657,329 referenced above. Alternatively, an amorphous alloy may deform in a uniform and homogeneous manner if the deformation is carried out pursuant to the present invention or pursuant to the method disclosed in application Ser. No. 657,329 referenced above. Inhomogeneous deformation is believed to be responsible for deterioration of magnetic properties of the deformed sample as compared to the properties prior to deformation.

We had previously discovered that there is a critical value for the stress to be applied to an amorphous alloy sample in order to deform it homogeneously and preserve good magnetic properties and this is the subject of application Ser. No. 657,329. We believe that the critical stress value is close to or approximately at the yield strength of an amorphous alloy sample. We believe that if the stress which is applied to deform the sample is less than the critical stress, then uniform deformation or homogeneous deformation can be achieved and the magnetic properties of the deformed sample can be preserved at their maximum for a deformed sample. On the contrary, if the stress applied is greater than the critical stress or greater than the yield strength of the sample, then discrete or inhomogeneous deformation will occur and deterioration of magnetic properties will result.

It is also our finding based on our understanding of the mechanism of deformation that it is feasible to extend and preserve useful tool life, such as die life, by applying less than the critical stress in carrying out the deformation.

BRIEF DESCRIPTION OF THE DRAWINGS

The explanation of the invention which follows will be made clearer by reference to the accompanying drawings in which.

DETAILED DESCRIPTION OF THE INVENTION

Figure 1:
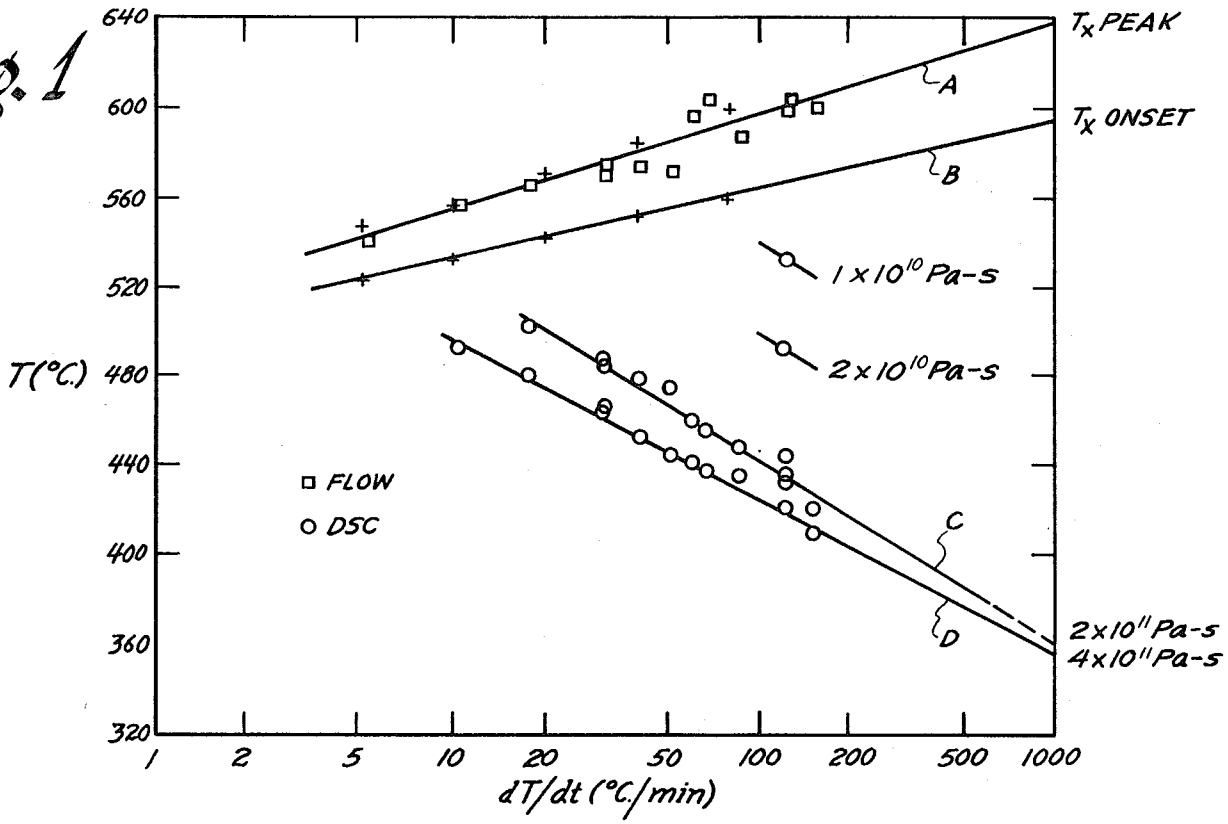
FIG. 1 is a graph illustrating temperature in degrees centigrade as the ordinate and the rate of heating in °C. per minute as the abscissa. This graph helps to illustrate the relationship between the subject matter of previous application Ser. No. 657,329 employing lower heating rates and the subject matter of the subject application which employs the much higher heating rates.

We have found that when an amorphous alloy sample is held at its softening temperature or is held isothermally at any temperature above the softening temperature after being heated to the test temperature at a relatively lower rate of 50° or 100° C. per minute, the viscosity or the flow resistance of the amorphous alloy increases significantly with time. In other words, the amorphous alloy begins to harden. We have found that the hardening occurs at a rate approximately equal to $10^9$ to $10^{10}$ Pa-s/s, or Pascals seconds per second for samples heated at the slower heating rates. Further, we have found that the value of the rate of hardening or rate of increase in viscosity can be determined quantitatively if the particular heating rate and holding temperature for a particular sample are known. If the softening temperature is considered to be the temperature at which the viscosity equals approximately $10^{10}$ Pa-s, then holding the sample isothermally for times greater than about 1 second hardens the alloy out of its softer state and into a harder state.

We have learned that this hardening effect can be overcome if the alloy is very rapidly heated prior to the forming operation. We have now found that such very rapid heating must be at temperature increase rates of 1000° C. per minute or higher. To put this another way, we have learned that if the forming operation is performed after the amorphous alloy has undergone very rapid heating at an extremely high rate, then the softening window; that is the temperature difference between the temperature at which the alloy softens and that at which it crystallizes, is large enough for the amorphous alloy to retain its ability to be worked in an apparent "soft" state even though the amorphous alloy temperature is not being ramped as the alloy sample is worked. In other words, a very rapidly heated sample can be worked although it is in an isothermal hold for periods greater than one second and up to several seconds depending on the rate of heating before the isothermal hold. Generally, the higher the rate of heating above 1000° C./min., the longer the isothermal hold which can be tolerated by the work piece without loss of favorable magnetic properties.

Further, if the rate of heating is sufficiently high, as for example, well above 1000° C./min., the work sample can be successfully worked without loss of favorable magnetic properties even though there is a slight decrease in the temperature of the work sample within the few seconds permitted before the work is performed on the work sample. For an iron based amorphous sample studied in relation to the FIG. 1 data and heated to about 500° C. at a heating rate of above 1000° C. per minute, a drop in the temperature of the work sample of about 20° C. prior to performing the work on the work sample will not prevent the attainment of the favorable properties in the worked sample. The extent to which the temperature of a heated sample may drop before it is worked increases with increased heating rate. For example, a sample heated at 2500° C./min. can undergo a larger temperature drop without deleterious effects than one heated at 1000° C/min. A sample treated in this fashion is deemed to have been worked while in an approximate thermal hold because the temperature decrease is not sufficient to detract from the favorable properties which are sought.

This use of an approximate thermal hold is of practical importance in the application of the subject process in industry. The reason is that it permits a sample to be heated in a heating station and to be then rapidly transported to a work station and subjected to the action of a tool at the work station without loss of favorable physical properties. Such loss of properties would occur in carrying out the process of copending application Ser. No. 657,329, referenced above.

To practice the present invention and to work or form an amorphous alloy, the alloy sample deformed should be heated in a controlled manner to ramp its temperature, that is to increase its temperature at a very rapid rate of increase prior to working. When the alloy sample has reached a temperature T which is greater than the softening temperature, Ts, the forming operation should be initiated. It has been found that it is not critical to the practice of the subject invention that the ramping of the temperature of the sample should be continued during the forming operation as is required in the practice of the method of application Ser. No. 657,329 referenced above. Rather, we have found that if the heating to a working temperature is rapid enough, the deleterious hardening which otherwise accompanies isothermal holds as a sample is worked can be overcome.

Further, if it is desired to avoid crystallization of the sample following the working operation, it is advisable to subject the sample to a fast cool-down after the forming is completed in order to avoid such crystallization.

The subject method is therefore distinct from the method of copending application Ser. No. 657,329 in that the method of the Ser. No. 657,329 application a lower heating rate is permitted, but isothermal holds as during working or deforming of the work piece must be avoided. However, according to the subject method, higher heating rates of 1000° C. per minute or higher are required, but the use of an approximate isothermal hold (including, where necessary, a slight temperature drop) of the amorphous metal work piece is not precluded in the method and are in fact permitted.

While not wishing to be bound by the accuracy of the theory it appears that when an amorphous alloy work specimen is heated to a temperature above the softening temperature, but below the crystallization temperature, at a rate of 1000° C. per minute or more, the hardening which occurs during a short isothermal hold does not prevent hot forming of the amorphous metal specimen without loss of the desirable magnetic properties.

In other words, we have found that by very rapidly increasing the temperature of the sample prior to the forming operation, there is, in effect, a counteracting of the "hardening" process which otherwise occurs. Because of the very rapid ramping of the temperature of the sample immediately prior to the forming, the amorphous alloy is maintained in a soft state during a short isothermal hold of several seconds. This effectively opens the "working window" for amorphous alloys in that it permits the deformation of the amorphous alloys in a wider range of processing parameters and in fact increases the processing parameters to a surprisingly greater extent than is feasible through use of the process of copending application Ser. No. 657,329 referenced above.

EXAMPLE 1

A sample of an amorphous metal ribbon and particularly a sample of a 1" wide ribbon of an iron boron silicon composition, specifically $Fe_{18}B_{13}Si_9$, was obtained from the Allied Corporation and was mounted in an Instron tensile testing apparatus. The ribbon itself was mounted to extend at its midsection through a furnace having a well-controlled temperature. In this first example, the teachings of Masumoto, as discussed above, were first considered. The portion of the sample in the furnace was ramped in temperature to a temperature above the softening temperature for the particular rate of heating employed. The ramping of the temperature was stopped and the temperature was held constant and the crosshead of the Instron was activated to exert tensile force on the sample. It was observed that the load which was required to deform the amorphous alloy increased linearly with time. This verified that a hardening of the amorphous alloy sample was in progress during the time when the temperature of the sample was held constant although it had already been heated to a temperature above its softening temperature.

In this specific example, the specimen was heated and the temperature was ramped at 123° C./minute until the specimen reached a temperature of 515° C. At that time, and at that temperature, the ramping of the temperature was stopped and the temperature was held constant in an isothermal hold. The crosshead motion on the Instron frame was then initiated to give a motion rate of 0.100 inch/minute. Within 30 seconds the stress required to deform the heated specimen changed from approximately 4 Mpa to approximately 50 Mpa.

EXAMPLE 2

The procedure of Example 1 was repeated but in this case the motion of the Instron crosshead was started without having terminated the ramping of the specimen temperature. Instead, the temperature was continuously ramped during the deformation. It was discovered that the amorphous alloy sample maintained the same rate of elongation at a nearly constant stress value of 5 Mpa. This method of working the amorphous metal sample is the method of Ser. No. 657,329 as referenced above.

EXAMPLE 3

The procedure of Example 2 was repeated but in this case the rate of movement of the crosshead was increased to the highest value at which the Instron can be made to operate, namely at 2 inches per minute. This is a strain rate equal to about 20%/minute. It was found that the stress required in order to maintain constant deformation as the temperature ramping of the sample was continued was only 88 Mpa. This is also an example according to the method of copending application Ser. No. 657,329.

EXAMPLE 4–46

In this series of examples, an effort was made to define a preferred set of operating conditions for use in the practice of the prior invention of Ser. No. 657,329. The parameters of these conditions pertain also to the practice of the subject invention although the heating rate for the subject invention must be at a rate in excess of 1000° C. per minute. The results of this study are included as data points in the graph of FIG. 1. This data is also significant to the present invention inasmuch as it includes ramping rates below about 1000° C. per minute as well as an extrapolation of the lower heating rate data to 1000° C./minute and above.

In FIG. 1, the temperature in °C. is plotted as the ordinate and the ramping rate, that is the rate at which temperature is changed with time, is plotted as a logarithmic function as the abscissa. However, pursuant to the present invention the minimum rate must be 1000° C. per minute or greater. Forty two data points are included on the graph, one point for each example. The upper diagonal line A of the graph extends through data points which represent crystallization values derived from both flow studies and calorimetry studies. These diagonal lines are extrapolated for practice of the present invention to ramping rate temperatures above 1000° C./min.

Only calorimetric studies were made to establish line B which represents the line of points at which crystallization starts to occur.

The upper line A, represents the series of points at which the rate of crystallization becomes a maximum. Here again, extrapolation to above 1000° C. is indicated.

Generally speaking, it was found that it was preferred to operate in parametric values i.e. at a temperature value (ordinate) and at a temperature ramping value (abscissa) below the line B of the Figure or the extrapolation of line B to ramping rates of above 1000° C./min and above.

To practice the present invention it is required that a certain ramping rate of above 1000° C./min. be applied to increase the temperature of the piece to be worked but it is also necessary that the working or straining of the piece or specimen be accomplished at a temperature which is below the temperature of onset of crystallization as represented by line B or its extrapolation above 1000° C./minute of FIG. 1.

Accordingly, the foregoing describes both the very high heating rate and the upper temperature at which the straining of the sample should be initiated to derive the benefits of the present invention.

Of course, it will be understood that there is also a lower temperature at which the straining should be initiated and this lower temperature can be found by reference to the set of two lines, line C and line D, at the lower part of FIG. 1. For the purposes of the present invention, the lines C and D are extrapolated to heating rates at or above 1000° C. per minute as this is the minimum heating rate for practice of the present invention.

What has been discovered is that to practice the present invention the preferred conditions are attained when the specimen which is being ramped at a heating rate at or above 1000° C. per min. is subjected to straining at a temperature above a minimum temperature also derivable from the extrapolation of the plot of FIG. 1.

The lower lines C and D, of FIG. 1 are derived from viscosity considerations and an explanation is given now of the basis on which these viscosity values are derived. The lowermost line, D, of FIG. 1 represents a viscosity value of $4\times10^{11}$ Pa-s (pascal-seconds). The upper of the two viscosity based lines, line C of FIG. 1, represents a viscosity value of $2\times10^{11}$ pascal-seconds. The pascal-seconds units are units of viscosity measurement and in this sense are similar to the value given in poise units in other systems. In fact, one pascal-second is equal to 10 poise.

Turning now to the tests which were conducted in obtaining the data which defines the lower temperature at which straining should be initiated and how the straining temperature relates to the ramping rate the following details are offered.

In this series of tests, amorphous alloys as referred to in Examples 1, 2 and 3 above were ramp heated at a ramping rate of dT/dt. The ramping rate is indicated as the abscissa of FIG. 1. The ramping was done under a constant load, herein identified as P, which was applied to the test specimen on a continuous basis during the period of the test. During the test, the deformation rate was monitored as a function of temperature. The data points for the two lower lines of FIG. 1 were obtained from these tests. For these tests the deformation rate $\dot{\epsilon}$ has been converted to a measure of viscosity designated as $\eta$ by normalizing. The applied stress is designated as $\sigma$. The following equation obtains:

$$\sigma=P/A$$

where A is the cross-sectional area of the ribbon being stressed.

The viscosity, $\eta$, is a measure of the flow resistance of the material of the specimen being ramped according to the following expression:

$$\eta=\tfrac{1}{3}\sigma/\dot{\epsilon}$$

Referring again now to FIG. 1, it is important to observe that the conditions which are prescribed for carrying out the process of the present invention can both be found from FIG. 1. The value in °C./min. of the rate of ramping of the sample is found from the abscissa and the temperature at which the working should be performed is found from the values of the ordinate. It had been found possible to accomplish a homogeneous working of the amorphous alloy specimen employing the conditions described in FIG. 1 by the methods taught in pending application Ser. No. 657,329 referenced above. FIG. 1 is similar to FIG. 1 of copending application Ser. No. 657,329 where the temperature ramping rate, dT/dt, stops at 500° C. per minute. In FIG. 1 of the subject application, the ramping rate is extended to 1000° C. per minute which is the minimum temperature ramping rate for practice of the method of the present invention.

With relation to homogeneous working of the sample, it is known in the field of metal working that the material being worked is strained at a rate on the order of 1 inch per inch per second. As an example of this rate, if a samples is initially 5 inches long and it is subjected to a deformation rate of 1 inch per inch per second, it will becomes 10 inches long at the end of 1 second.

It has been found that in order to maintain good magnetic properties, the alloy must be able to be deformed homogeneously at at least this rate, i.e., at a rate of 1 inch per inch per second. Further, this homogeneous deformation requires that the applied stress be less than about the yield strength of the amorphous alloy. This critical stress is about $10^{11}$ Pa.

Accordingly, the viscosity $\eta=\tfrac{1}{3}\sigma/\dot{\epsilon}$, must be less than about $10^{11}$ Pa-s.

Accordingly, the homogeneous deformation of an amorphous alloy can be accomplished by applying a ramping rate to bring the sample to a temperature which is within the designated zone on the right hand margin of FIG. 1 between lines B and D. A preferred range is within the zone on the right hand margin of FIG. 1 between lines B and C and the extrapolation thereof to higher heating rates.

In prior application Ser. No. 657,329, it was emphasized that homogeneous deformation of samples could be accomplished only if the temperature is ramped as the sample is deformed. By contrast, we have now discovered that according to the method of this invention homogeneous deformation can be accomplished during an isothermal hold, that is immediately after the temperature of the work piece has been very rapidly heated at a rate of at least 1000° C. per minute into the desired temperature range, but while the temperature of the work piece is not being ramped. The upper level of desired working temperature range is also evident from the right margin of FIG. 1 and the extrapolation thereof to the right of the FIGURE. From this figure it is evident that the working temperature cannot be greater than that shown by the line B of the right margin of FIG. 1 as this is the temperature at which crystallization is initiated. If deformation is carried out at higher temperatures, then the magnetic properties of the sample degrade due to the crystallization of the sample.

The foregoing Examples 4–46 are specific to an alloy of FeBSi and particularly to an alloy identified as a 1" wide ribbon of $Fe_{78}B_{13}Si_9$.

However the method of the present invention is not limited to this specific alloy but is useful in connection with a wide range of amorphous alloy strips and wires.

Figure 2:
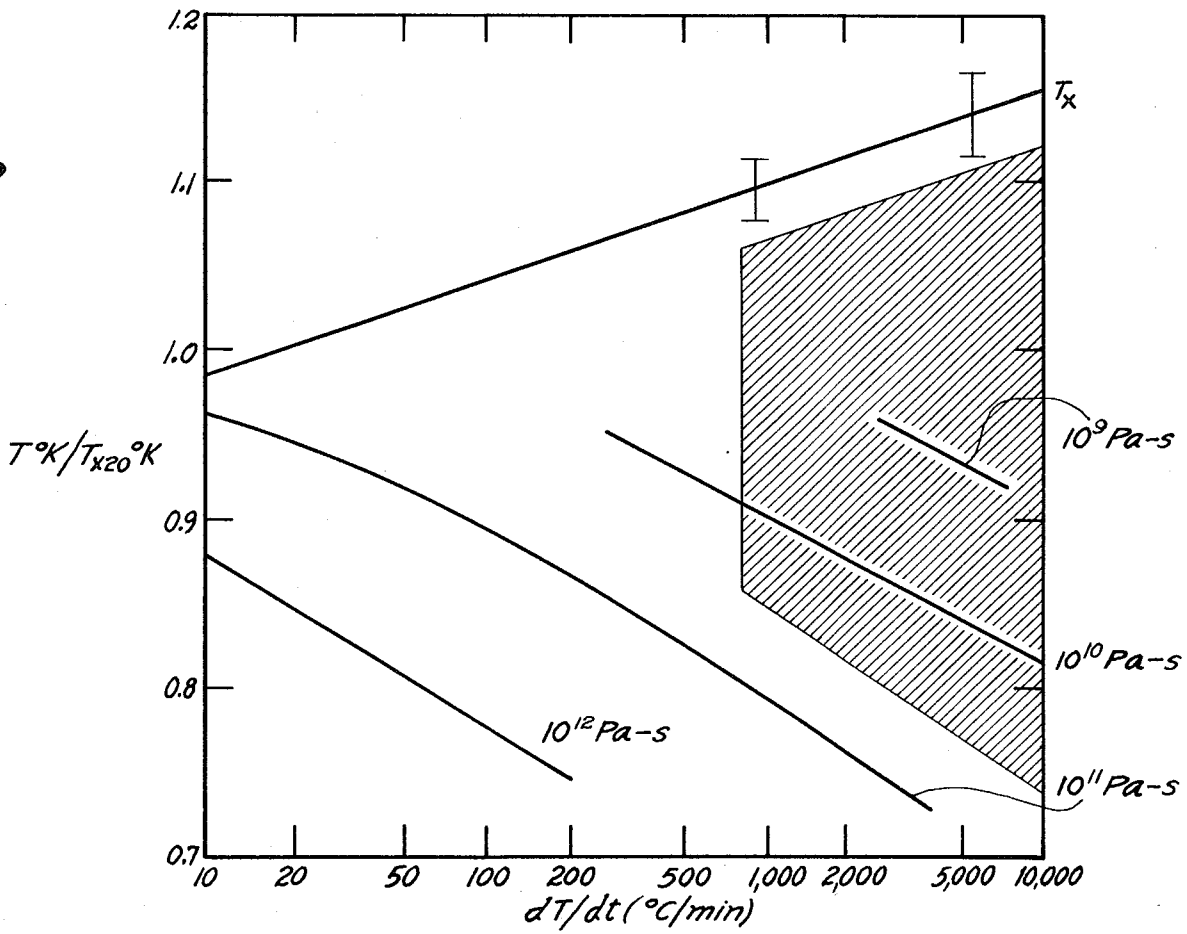
FIG. 2 is a graph which is similar to that of FIG. 1 but which is visualized to present a broader scope of the invention in a graphic fashion based on a more extensive set of calculations which extend the ramp heating from the lower heating rate range of experimental data, and which has been hatched to illustrate the preferred range of operating parameters.

As a means of expressing this broader scope of the invention the data as presented in FIG. 1 has been generalized and has been presented in FIG. 2.

In FIG. 2 the ratio of the temperature, T, in °K. to the temperature of the onset of crystallization, as measured calorimetrically at 20° C./min., and reported as $T_x$ in °K., is plotted against the ramping rate dT/dt in °C. per minute. FIG. 2 of this application is similar to FIG. 2 of the copending application Ser. No. 657,329 referenced above, but its most relevant portion to the subject invention is that concerning heating rates, dT/dt, at and above 1000° C./min.

We have established that the relationship expressed by the graph of FIG. 2 is valid for the working of a broad range of amorphous alloys.

We have established that the flow and viscosity parameters for all amorphous alloys can be reduced to the master curves as presented in FIG. 2. These curves are derived by normalizing the curves for individual alloy systems such as is presented in FIG. 1. The normalizing is accomplished by expressing the specimen temperature as a ratio of its actual temperature in °K. to the temperature, Tx, for the onset of crystallization for the amorphous alloy system under study. The temperature, Tx, for onset of crystallization is that determined by differential scanning calorimetry at 20° C./min.

FIG. 1 presents the temperature of a sample being ramped in °C. as the ordinate of the graph whereas FIG. 2 presents the temperature of a sample being ramped as the ratio of the temperature in °K. to the temperature, Tx, of the onset of crystallization in °K. for the particular amorphous alloy being ramped. The graph of FIG. 2 has been established as a master graph for all amorphous alloys. Approximate error bars are impressed on the upper line of the graph of FIG. 2. This upper line represents the temperatures for the onset of crystallization for the different ramping rates designated along the abscissa. The error bars illustrate the variation in the temperatures of onset of crystallization which are due to compositional variations of crystallization behavior.

In practicing the invention, and with reference now to FIG. 2, the coordinates of ramping temperature as presented on the abscissa and the temperature ratio as presented on the ordinate which in combination permit the desirable magnetic properties of an amorphous alloy to be retained, are those found to the right of the 1000° C. per minute line of FIG. 2 and between the upper and the lowermost line on the graph.

The graph of FIG. 2 includes ramping temperatures up to 1000° C. per minute as well. It will be understood however that the method operates for ramping temperatures at and above 1000° C. per minute and within ranges of coordinates which lie within extensions of the lines of FIG. 2 to ramping temperatures of 10,000° C. per minute and higher.

A very important consequence of the more rapid rates of heating is evident from a consideration of the viscosity plots which are included in FIG. 2 and a comparison of the viscosity of plots of FIG. 2 with those of FIG. 1. In particular, it is evident that very low values of viscosity are attained as a result of the very rapid heating rates. For example, plots of the viscosity of rapidly heated samples having values of $10^{11}$ Pa-s and $10^{10}$ Pa-s and even of $10^9$ Pa-s are displayed in the graph of FIG. 2. Because such viscosity values are obtained, some approximate thermal holds which include a small drop in temperature are feasible. Such thermal holds can be carried out and the samples will still remain soft enough for working uniformly and without significant loss of valuable magnetic properties.

Further for amorphous alloys which have been given an anneal prior to practice of the present invention, the relationships established and plotted in FIG. 2 remain valid but the lower line of the graph will be shifted upward. The degree of shift will increase with increase in the degree of pre-anneal.

What is claimed and sought to be protected by Letters Patent of the United States is as follows:

1. A method of deforming an amorphous alloy without destroying its magnetic properties which comprises
- providing an amorphous alloy specimen,
- ramping the temperature of the specimen at a rate at or above 1000° C./min which preserves its viscosity at a low value of less than $4\times10^{11}$ Pa-S,
- heating the specimen to above its softening temperature and below its recrystallization temperature,
- stressing the specimen to deform the specimen at or below its yield strength after the temperature has been ramped to above its softening temperature.

2. A method of forming an amorphous alloy without destroying its magnetic properties which comprises
- providing an amorphous alloy specimen,
- ramping the temperature of the specimen at a rate dT/dt at or above 1000° C. per minute which can bring the temperature ratio $T°K/T_x°K.$, to within the hatched area of the graph of FIG. 2 to the right of the 1000° C./min. value of the abscissa,
- stressing the specimen to deform the specimen at or below its yield strength after the temperature has been ramped at or above 1000° C. per minute to above the softening temperature and below its crystallization temperature.

3. The method of claim 2 wherein the coordinates are within the area to the right of the 1000° C. per minute ordinate of FIG. 2.

4. The method of claim 2 in which the coordinates are extrapolated to temperatures above 10,000° C./min. of the graph of FIG. 2.

5. The method of claim 2 in which the coordinates of the area are extrapolated to above 10,000° C. of the graph of FIG. 2 and the sample has been held in a thermal hold for more than one second.

6. The method of claim 3 wherein the coordinates are extrapolated to above 10,000° C./min. within the designated area of FIG. 2.

7. The method of claim 1 in which the alloy is the composition $Fe_{78}B_{13}Si_9$, the ramping rate is about above 1000° C. per minute and the onset working temperature is about 520° C.

8. The method of claim 1 in which the alloy is the composition $Fe_{78}B_{13}Si_9$, the ramping rate is about 1000° C. per minute and the onset working temperature is between 480° C. and 540° C.

9. The method of claim 1 in which the alloy is the composition $Fe_{78}B_{13}Si_9$, the ramping rate is about 1000° C. per minute and the onset working temperature is between 460° C. and about 560° C.

10. The method of claim 1 in which the alloy is the composition $Fe_{18}B_{13}Si_9$, the ramping rate is about 1000° C. per minute and the onset working temperature is between about 440° C. and 580° C.

* * * * *